US005590577A

United States Patent [19]

Ruf et al.

[11] Patent Number: 5,590,577

[45] Date of Patent: Jan. 7, 1997

[54] DEVICE FOR CUTTING A PAPER WEB IN A PRESS END OF A PAPER MACHINE

[75] Inventors: Gunther Ruf, Syrgenstein; Hans-Jorg Burbach, Heidenheim, both of Germany

[73] Assignee: J.M. Voith GmbH, Germany

[21] Appl. No.: 64,233

[22] Filed: May 19, 1993

[30] Foreign Application Priority Data

May 20, 1992 [DE] Germany ..... 42 16 653.5

[51] Int. Cl.[6] ..... B26D 5/20

[52] U.S. Cl. ..... 83/371; 83/360; 83/177; 162/255

[58] Field of Search ..... 83/76.1, 155.1, 83/167, 177, 371, 364, 365; 162/263, 255, DIG. 10; 225/100; 101/224, 226

[56] References Cited

U.S. PATENT DOCUMENTS

| | | | |
|---|---|---|---|
| 2,864,284 | 12/1958 | Proffen | 162/255 |
| 2,888,073 | 5/1959 | Corbin et al. | 162/255 |
| 2,954,082 | 9/1960 | Moore | 162/255 |
| 3,096,233 | 7/1963 | Rappaport et al. | 162/255 |
| 3,151,482 | 8/1964 | Forrester et al. | 83/371 |
| 3,552,252 | 1/1971 | Maxey et al. | 83/371 |
| 3,797,719 | 3/1974 | Tall et al. | 225/100 |
| 4,071,899 | 1/1978 | Holy | 83/371 |
| 4,648,942 | 3/1987 | Wanke et al. | 162/255 |
| 4,799,997 | 1/1989 | Thompson | 162/255 |

*Primary Examiner*—Rinaldi I. Rada
*Assistant Examiner*—Allan M. Schrock
*Attorney, Agent, or Firm*—Ostrolenk, Faber, Gerb & Soffen

[57] ABSTRACT

A cutting-off device and at least one tear detector are provided for cutting a web of paper in a press end of a paper machine, in response to a tear in the web of paper in a single-tier dryer end, the tear of the web of paper being recognized via a tear signal and transmitted to the cutting-off device. The tear detector has a transmission/reception base unit, which, on the one hand, at the start of a production cycle, or whenever a tear in the paper web is detected, records and stores the spectrum of the existing shade of color of the corresponding dryer felt, and possibly updates the stored shade of color at the time of subsequent tears. On the other hand, upon a later tear in the paper web, the base unit compares the shade of color of the dryer felt at the existing tear and the previously stored shade of color. If they match, the base unit activates the cutting-off device when (and only when) the stored shade of color of the dryer felt is recognized.

13 Claims, 2 Drawing Sheets

DEVICE FOR CUTTING A PAPER WEB IN A PRESS END OF A PAPER MACHINE

BACKGROUND OF THE INVENTION

The present invention relates to a device including a cutting device and at least one tear detector for cutting a web of paper in a press end of a paper machine, in response to a tear in the paper web in the dryer end.

In the manufacture of paper, the desire for maximum productivity is leading to plants with constantly higher production capacities and accordingly also to machines with constantly increasing speeds. The speed limits in this connection frequently arise from the drying section or the drying capacity available there, and from the danger of the paper web tearing. It is readily clear that forces which are not problematical at low speeds result, in the case of high-speed paper machines, in phenomena such as fluttering of the web and the like, as the result of which the web of paper may then tear.

Such tears of course cause a reduction in production. One particular problem in connection with such tears is that if the tear remains unnoted, the web of paper travels in a completely uncontrolled manner through the drying end. The drying end may become completely clogged to a greater or lesser extent, which may possibly require long periods of delay for the removal of the shreds of paper. Or, wrapping can occur, as a result of which the journals of the corresponding shaft may break. The dryer felts (dryer wires) of the drying end may also be destroyed.

SUMMARY OF THE INVENTION

The general object forming the basis of the present invention is to avoid the various disadvantages that can occur when a paper web breaks in the dryer end of a paper machine.

A more specific object is to deal with an unintended, and to this extent also uncontrolled, tear in the paper web.

These and other objects are achieved by associating with the press end of a paper machine a cutting device which cuts through the web of paper passing through it if a tear in the paper web is recognized in the following dryer end.

The above-mentioned problem is solved in the case of a so-called two-tier dryer end by arranging a light barrier in the region of the open draw of paper between every two dryer groups in the dryer end, a beam of light of the barrier being directed against the web of paper. If the latter tears, the light barrier is activated and the cutting device is actuated.

In so-called single-tier dryer ends, there is no comparable open draw of paper between the dryer groups, so that it is difficult to employ the solution of monitoring the presence of the web of paper by means of a light-dark sensor. A known light-dark sensor was tried out in connection with single-tier dryer ends by applying a sort of contrast stripe with black ink to the dryer felt, the stripe being always visible and thus detectible when the web of paper had been torn, as seen in the direction of travel. Therefore, as long as the web of paper covered the dryer felt, the contrast stripe was also covered and the tear detector showed a quasi-normal condition. As soon as the web of paper tore, the tear detector could recognize the contrast stripe and the cutting device was actuated. Such coloring of the contrast stripe, however, constitutes a problem insofar as the structure and thus the drying properties of the dryer felt in the region of the contrast stripe are affected by the coloring, with the result that the web of paper does not dry out completely uniformly over its entire width.

A further object of the present invention, therefore, is to provide a device by which clear recognition of a tear of the paper is possible and accordingly by which a clear tear signal can be generated without any change in the structure of the dryer felt, particularly in a single-tier dryer end.

This object is achieved by the configuration disclosed and claimed herein.

A cutting-off device and at least one tear detector are provided for cutting a web of paper in a press end of a paper machine, in response to a tear in the web of paper in a single-tier dryer end, the tear of the web of paper being recognized via a tear signal and transmitted to the cutting-off device. The tear detector has a transmission/reception base unit, which, on the one hand, at the start of a production cycle, or whenever a tear in the paper web is detected, records and stores the spectrum of the existing shade of color of the corresponding dryer felt, and possibly updates the stored shade of color at the time of subsequent tears. On the other hand, upon a later tear in the paper web, the base unit compares the shade of color of the dryer felt at the existing tear and the previously stored shade of color. If they match, the base unit activates the cutting-off device when (and only when) the stored shade of color of the dryer felt is recognized.

There are a large number of different dryer felts available on the market, these dryer felts differing greatly both with respect to their basic color and with respect to their structure. If these dryer belts change their optical appearance over the course of time, for instance over the course of their three to six month period of suitability for use, as a result of dirt and wear, and particularly if the contrast with respect to the color of the paper itself decreases, it is difficult to employ a simple "presence control" successfully.

Furthermore, the dirtying, i.e. dusting, of the optical system of the tear detector can possibly lead to an uncertain recognition signal and thus to an erroneous tear signal. The cutting device is to be actuated when (and only when) a tear which has been presumably recognized is also confirmed as an actual tear; only in such case should the cutting device be actuated. If the tear signal is recognized but is not confirmed, since, for instance, it was falsely generated, then the production cycle is not to be interrupted.

Other features and advantages of the present invention will become apparent from the following description of an embodiment of the invention which refers to the accompanying drawings.

DETAILED DESCRIPTION OF THE INVENTION

Figure 1:
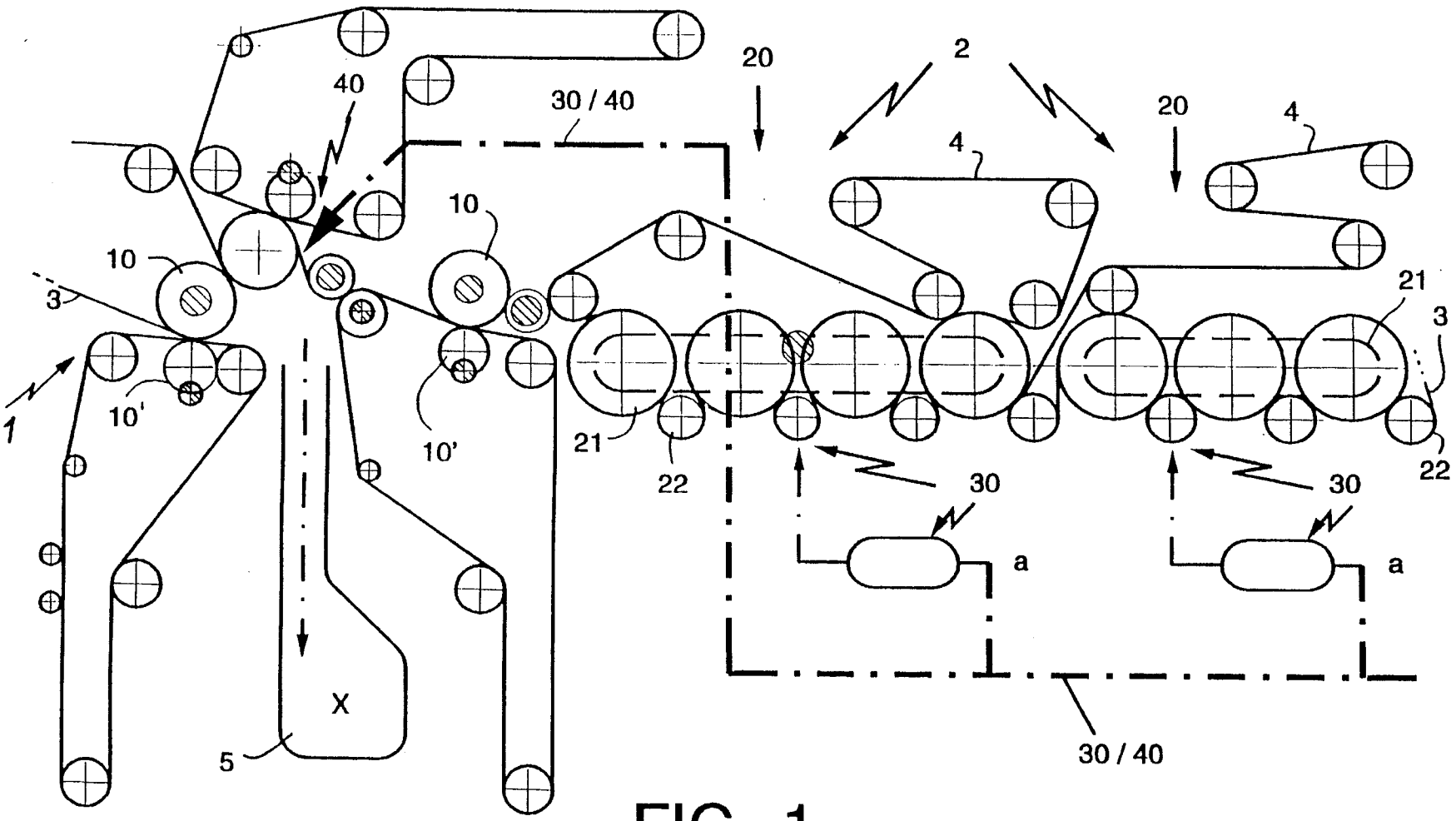
FIG. 1 shows a schematic diagram of a press end and a subsequent dryer end of a paper machine, including a cutting device in the press end and at least one tear detector in the dryer end-for causing the cutting device to cut a web of paper when a tear in the dryer end is detected.

FIG. 1 shows a portion of a paper machine including a press end 1 and a single-tier dryer end 2 having several dryer groups 20. The web of paper 3 which is to be produced is fed through the press end 1 from the left, as seen in the drawing, and passes there in succession between press rolls 10, 10' arranged in pairs opposite each other. The press end 1 is followed by the dryer end 2 which, in accordance with the principle of contact wire guidance, in each dryer group has four dryer cylinders 21, four guide rolls 22, and a dryer felt 4 which passes in meandering form between them. There may be several such dryer groups 20. A second dryer group 20 is partially shown. At the end of the dryer end 2, the paper web 3 is rolled up (in a manner not shown).

The basic object of the present invention is achieved by clearly identifying a tear in the web of paper 3 which occurs or is recognized in a dryer group 20 and, by means of a tear signal, preventing the further feeding of the web of paper 3 to the dryer end 2. The paper web 3 is rather to be conducted directly from the press end 1 into a so-called pulper 5 in which the paper (which has just been produced) is broken down with water again into pulp.

Every dryer end 2 has at least one tear detector 30. In this embodiment, each dryer group 20, or every two dryer groups 20, can have a tear detector 30 associated with them, which detectors are then functionally coupled via a common control line 30/40 with a mechanical cutting device 40, for instance in the form of a conventional blast tube. The signals which actuate the blast tube are also known. This functional connection is shown by a dot-dash line in FIG. 1. If an actual tear in the paper is thus detected in a tear detector 30, the detector gives off a tear signal a to the control line 30/40 through which an actuating signal is transmitted to the cutting device 40. The cutting-off device 40 is arranged alongside the paper web 3, possibly along both sides of the paper web, and thus partially cuts through the paper web. Due to the traction forces acting on the paper web 3, it is torn over its entire width. The free end of the paper web is then conducted into the pulper 5 (see arrow X). In the embodiment shown, the cutting device 40 is arranged in front of the next-to-last pair of press rolls 10, 10' as seen in the direction of travel of the paper.

According to the invention, the cutting device 40 is to be actuated, or is to be able to be actuated, when, and only when, a detected tear is recognized as a true tear by the tear detector 30. This is accomplished by a comparison of the shade of color of the corresponding dryer felt 4, which is updated after each tear of the paper web by the TEACH-IN method, with the instantaneously identified shade of color of the paper web at this tear. A tear signal should not be issued merely on the basis of certain irregularities, which may simulate a tear.

Figure 2:
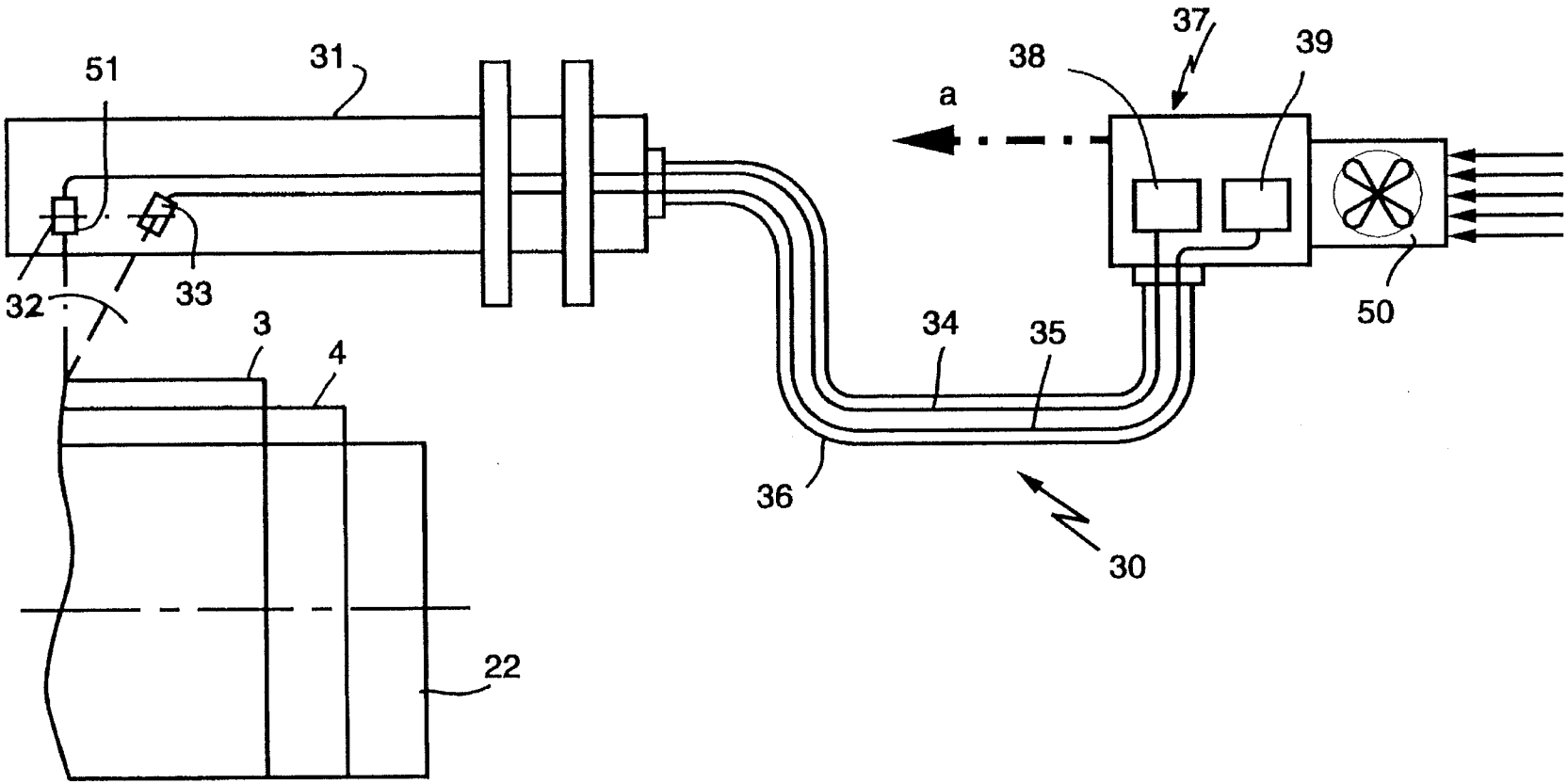
FIG. 2 is a schematic diagram of one embodiment of a tear detector.

FIG. 2 is a schematic diagram of one embodiment of the tear detector 30 of FIG. 1, functionally associated with a guide roll 22 which is surrounded by the dryer felt 4 on which the paper web 3 rests.

At a distance away (of about 100 to 110 mm), the edge of the web of paper 3 lies opposite a measurement tube 31 which, on the one hand, has a transmission unit 32 and, on the other hand, a reception unit 33. The measurement tube 31 is functionally coupled via a pair of light guides 34, 35 (about 10 meters in length, protected by a protective hose 36) to the base unit 37 of the tear detector 30.

The manner of operation of the measurement and evaluation device comprising the measurement tube 31 and the base unit 37 is as follows:

Visible light, for example, is transmitted via a transmission unit 38, consisting, for example, of a halogen lamp, of the base unit 37 via the associated light guide 34 to the transmission unit 32 and from there is irradiated approximately perpendicularly onto the web of paper 3. The reception unit 33 is arranged obliquely (for instance at an angle of 30°) to the direction of radiation and receives the light reflected by the web of paper 3 in order to transmit it, via the light guide 35, to a reception unit 39 of the base unit 37. Here, the reflected light is broken down by suitable filters into standard red, green and blue light values, which are measured. Possibly an additional brightness value may also be measured. In the case of white light, 33.33% of the brightness corresponds to each of the red, green and blue light values.

At the beginning of each production cycle and upon the occurrence of a true tear, the shade of color of the corresponding dryer felt 4, that is, its spectral decomposition, is measured, analyzed and stored in the reception unit 39, so that, in a manner similar to the TEACH-IN method, the shade of color of the dryer felt 4 is thus made available for a comparison. Thus, in the case of an actual tear, an unambiguous decision can be made by a comparison—effected by evaluation logic of the reception unit 39—between the stored value of the dryer felt 4 and a (present) measured value of the dryer felt 4 (with the paper web torn). If those two values are the same, a tear in the web of paper is present. Only in that case is the cutting device 40 actuated.

As a result of the above-described function of the tear detector 30 shown in FIG. 2, it is assured that dirt in the region of the measuring device and in the region of the dryer felt will not lead to an undesired activation of the cutting device 40 and an undesired interruption of production.

In addition to the measurement value for the shade of color of the dryer felt 4, a signal which represents the web of paper can also be stored so as to contribute to continuous automatic functional control of the paper machine.

It is possible to store corresponding values of the shade of color of the dryer felt 4 both manually (by the pushing of a key) and automatically (via a memory control). And referring to FIG. 2, it should furthermore be pointed out that the base unit 37 has a fan 50 associated with it by which air is blown through the protective hose 36, to the measurement tube 31. This air emerges at the opening 51 associated with the transmission unit 32 in the measurement tube 31 and serves to keep the measurement surface and the measurement optics clean.

A basic aspect of the operation of the entire device is the wavelength and intensity of the reflected light received in the reception unit 33. The base color of the dryer felt is not critical. However, the dryer felt should not have the same color as the paper—in that case, the color of the dryer felt must be properly selected.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for cutting a paper web in a press section of a paper machine in response to a tear in the paper web in a single-tier dryer end of the paper machine, comprising:

at least one cutting device in the press section, at least one tear detector in the dryer end, and a control line interconnecting the cutting device and the tear detector;

the tear detector having a measuring unit directed toward a portion of the paper web and a dryer felt for measuring optical characteristics of the dryer felt, and a base unit with circuitry for receiving and storing initial values representing signals from said measuring unit representative of said optical characteristics at an initial time, wherein the base unit is connected via light guides with the measuring unit which is associated with and directly adjacent to the web of paper, said measuring unit having a transmission unit for radiating a measurement light beam and a reception unit to receive light reflected by the web of paper and by the dryer felt;

the base unit circuitry further detecting the tear in the paper web by detecting present optical characteristics of said dryer felt at a second time subsequent to said initial time and matching said present optical characteristics with said optical characteristics detected at said initial time; and the base unit circuitry further sending a cutting signal to said cutting device on said control line when the tear is detected so as to cause said cutting device to cut the paper web in the press section.

2. A device as in claim 1, wherein the base unit further records and stores a spectrum of an existing shade of color of the dryer felt upon the start of a production cycle and upon each detected tear of the paper web.

3. A device as in claim 2, wherein the base unit further records and stores a spectrum of an existing shade of color of the paper web.

4. A device as in claim 2, wherein the base unit analyzes and stores the shade of color of the dryer felt, as a function of reflection properties of the dryer felt, in a form of standard red, green and blue light values.

5. A device as in claim 4, wherein the base unit further records and stores a brightness value.

6. A device as in claim 1, wherein the base unit, in the event of a subsequent tear of the paper web, actuates the cutting-off device if and only if the shade of color of the dryer felt at the tear matches the stored initial values.

7. A device as in claim 6, wherein the base unit stores and records an updated color shade upon each subsequent tear in the paper web.

8. A device as in claim 1, wherein the base unit further has a fan associated with it for keeping measurement optics clean, by which fan air is blown along the light guides to the measuring unit and to the web of paper.

9. A device according to claim 1, wherein the measurement light beam is provided to the transmission unit of the measuring unit from a halogen lamp in the base unit via said light guides.

10. A device for cutting through a web of paper in the press section of a papermaking machine, that has been torn while in the single-tier dryer end of the papermaking machine, the device having a paper cutter and at least one paper-tear detector, the device indicating the presence of the tear by the transmission a signal to the cutter; wherein:

a) the detector comprises a combination emitter-receiver unit, wherein the emitter-receiver unit communicates through an optical conductor with a remote unit in the immediate vicinity of the web, the remote unit having a first component that emits a beam of light, and a second component that absorbs light reflected from the felt through the tear in the paper;

b) the emitter-receiver unit detects and stores an initial color spectrum of drying felt at the dryer end whenever a new production cycle of the papermaking machine begins and whenever a tear is detected in the paper;

c) when the paper tears, the emitter-receiver unit detects the tearing of the paper by matching a second color spectrum of the dry-end felt which it detects through the tear, with the initial color spectrum stored in its memory, and in response, activates the paper cutter; and d) the emitter-receiver unit analyzes and stores the color of the felt as a function of reflection properties in a form of standardized red, green and blue light values.

11. A device as in claim 10, wherein said emitter-receiver unit also analyzes and stores the color of the felt as a function of a brightness value.

12. A device as in claim 10, further comprising a fan and a protective hose and air is conveyed from said fan to the emitter-receiver unit, through the hose to the remote unit, and to the surface being monitored.

13. A device as in claim 10, wherein the emitter-receiver unit contains a halogen lamp for producing light to be communicated through said optical conductor to said remote unit.

* * * * *